US005979816A

United States Patent [19]

Blankenship et al.

[11] Patent Number: 5,979,816

[45] **Date of Patent: *Nov. 9, 1999**

[54] SWIVEL RELEASE ROPE SPOOL

[75] Inventors: Kyle E. Blankenship; Kelly D. Stephens, both of Houston, Tex.

[73] Assignee: K-Squared, Inc., Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/935,815

[22] Filed: Sep. 23, 1997

[51] Int. Cl.[6] ..... B65H 75/44; B63B 21/04

[52] U.S. Cl. ..... 242/400.1; 242/404.2; 114/218

[58] Field of Search ..... 242/400.1, 404.1, 242/404.2, 405.1, 405.2; 403/78, 373; 256/68, 69, 65; 114/218, 219, 220, 343, 354; 254/243, 213, 214, 215; 24/569, 535

[56] References Cited

U.S. PATENT DOCUMENTS

| | | |
|---|---|---|
| 3,168,260 | 2/1965 | Kittelson . |
| 3,608,860 | 9/1971 | Horn . |
| 3,829,824 | 8/1974 | Pillischafske . |
| 3,926,383 | 12/1975 | McConnell . |
| 4,277,035 | 7/1981 | Gaski . |
| 4,361,024 | 11/1982 | Haldric . |
| 4,809,393 | 3/1989 | Goodrich et al. . |
| 5,513,816 | 5/1996 | Grubb . |
| 5,655,728 | 8/1997 | Yang . |

*Primary Examiner*—Donald P. Walsh
*Assistant Examiner*—William A. Rivera
*Attorney, Agent, or Firm*—Howard L. Speight

[57] ABSTRACT

An apparatus and method for providing a swivel release rope spool including a first mounting surface; and a first rotatable cleat detachably attached to the first mounting surface.

10 Claims, 9 Drawing Sheets

SWIVEL RELEASE ROPE SPOOL

BACKGROUND

Ropes, cords, electrical cords and other rope-like materials find application in a variety of environments. For example, electrical "extension" cords are used to carry electrical power from a receptacle to a remote location where an electrical appliance is to be used. Further, sail boats and ski boats use rope for a variety of reasons, such as sheets, tie downs, and in the case of a ski boat, the ski rope itself.

In many situations it is awkward to store the rope or cord when it not being used. Electrical cords may be wound around a person's arm and then tied up for later use. Alternatively, the electrical cord may be stored wrapped around a spool. In the former situation, the cord frequently becomes knotted or kinked, making it difficult to use the next time. In the latter situation, the cord must be unwrapped from the spool before it can be used.

On sail boats or ski boats, lines or ropes are sometimes loosely coiled and wrapped and then thrown to the bottom of the boat where they can get in the way or even become dangerous. Alternatively, they may be wrapped around cleats provided for that purpose. In that case, the rope or line must be unwrapped from around the cleats before it can be used.

Some electrical appliances, most notably the vacuum cleaner, have addressed this problem by providing cleat-like fixtures formed into the body of the appliance which can be released by rotating one of the fixtures to release the cord.

SUMMARY OF THE INVENTION

In general, in one aspect, the invention features a swivel release rope spool comprising a first mounting surface; and a first rotatable cleat detachably attached to the first mounting surface.

Implementations of the invention may include one or more of the following. The swivel release rope spool of claim 1 may further comprise a second mounting surface; and a second rotatable cleat detachably attached to the second mounting surface; the second rotatable cleat being oriented relative to the first rotatable cleat in such a way as to form a spool. The swivel release rope spool may further comprise a strap. The strap may comprise an elongated strip having a hook receptor side; a patch attached to the side of the elongated strip opposite the hook receptor side, the patch having hooks; and a wrapping strip attached to the elongated strip, the wrapping strip having hooks. The swivel release rope spool may further comprise a first cleat mount for connecting the first rotatable cleat to the first mounting surface. The first cleat mount may comprise a plate. The first cleat mount may comprise a clamp lock. The clamp lock may comprises a cleat attachment arm; a clamping arm; and a spring, the spring attached to the cleat attachment arm and the clamping arm, the spring configured to snap onto and off of the first mounting surface. The clamp lock may comprise a slide mount comprising a tube gripping cylinder; an upper arm attached to the tube gripping cylinder; and a lower arm attached to the tube gripping cylinder.

In general, in another aspect, the invention features a swivel release rope spool comprising a cleat mount; and a cleat attached to the cleat mount.

Implementations of the invention may include one or more of the following. The cleat mount may comprise a plate. The cleat mount may comprise a clamping lock.

In general, in another aspect, the invention features a method for providing a swivel release rope spool comprising mounting a first rotatable cleat on a first surface; and rotating the first rotatable cleat in a first direction to open it.

Implementations of the invention may include one or more of the following. The method may further comprise rotating the first rotatable cleat in a second direction to close it. The method may comprise mounting a second rotatable cleat on a second surface; and orienting the second rotatable cleat relative to the first rotatable cleat so that the rotatable cleats form a spool. The method may further comprise opening one of the cleats to open the spool. The method may further comprise opening both of the cleats to open the spool. Mounting may comprise attaching the first rotatable cleat to a first mounting plate, the mounting plate being attached to the first surface. Mounting may comprise attaching the first rotatable cleat to a clamp lock; and snapping the clamp lock onto the first surface. Mounting may comprise attaching the first rotatable cleat to a clamp lock; and sliding the clamp lock onto the first surface.

DESCRIPTION

Figure 1:
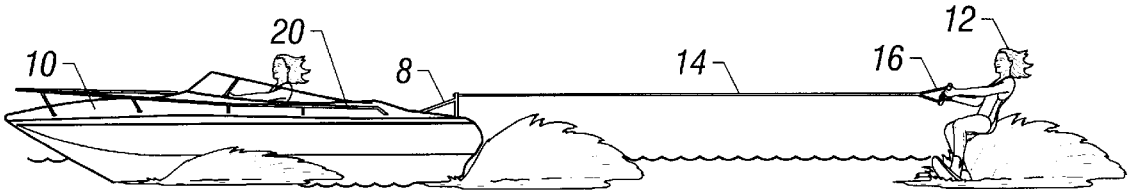
FIG. 1 is a perspective view of a ski boat pulling a skier.

A ski boat 10 pulls a skier 12 attached to the ski boat 10 by a ski rope 14, as shown in FIG. 1. The skier 12 grips a handle 16 which is attached to the ski rope 14. The other end of the ski rope 14 is attached to a ski riser 18 which transfers the forces imposed by the action of pulling the skier 12 from the ski rope 14 to the body of the ski boat 10. The ski boat 10 also has a side rail 20, which is used for a variety of purposes including hanging bumpers (not shown) over the side of the ski boat 10 to protect its surface from docks or other boats.

In the prior art, when the ski boat 10 is not pulling a skier, the ski rope 14 is pulled into the ski boat 10 to avoid being a hazard to other skiers or boats in the water. When the ski rope is pulled into the boat, it is generally left in the bottom of the boat where it can be a hazard.

Figure 2A:
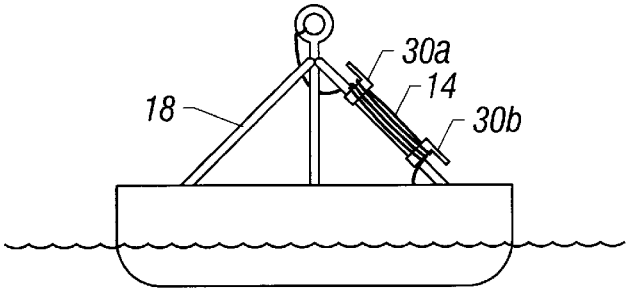
FIGS. 2A and 2B are perspective views of the rear of a ski boat.

A swivel release rope spool consists of two parts 30*a* and 30*b* which attach to the ski riser 18 as shown in FIG. 2A. In the position shown in FIG. 2A, the two parts of the swivel release rope spool form a spool allowing the ski rope 14 to be wound around it, providing safe and secure storage for the ski rope 14 when it is not in use.

Figure 3A:
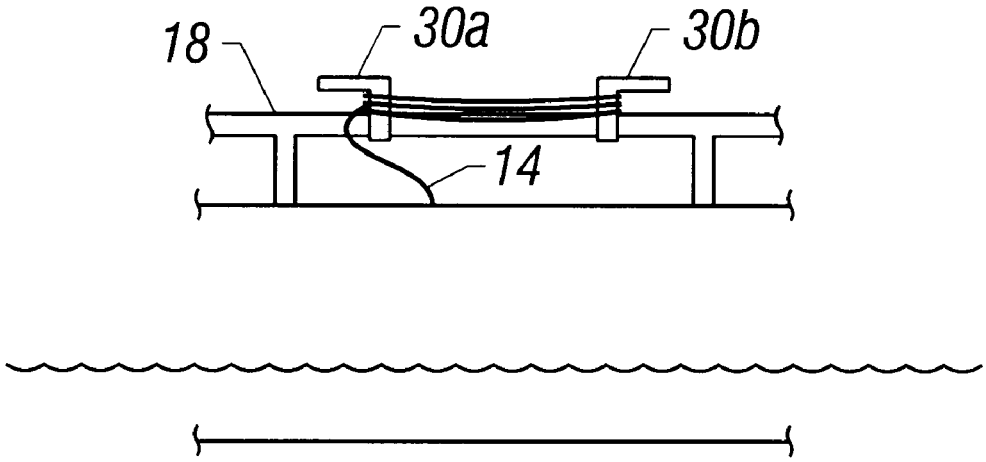
FIGS. 3A and 3B are perspective views of the side of a ski boat.

The two parts of the swivel release rope spool may also be attached to the side rail 20, as shown in FIG. 3A. The ski rope 14 extends from the back of the ski boat 10, wraps around the swivel release rope spool 30*a* and 30*b* with the handle 16 laying in the bottom of the boat.

Figure 2B:
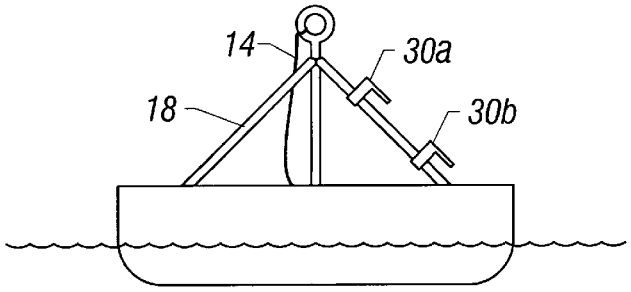
Figure 3B:
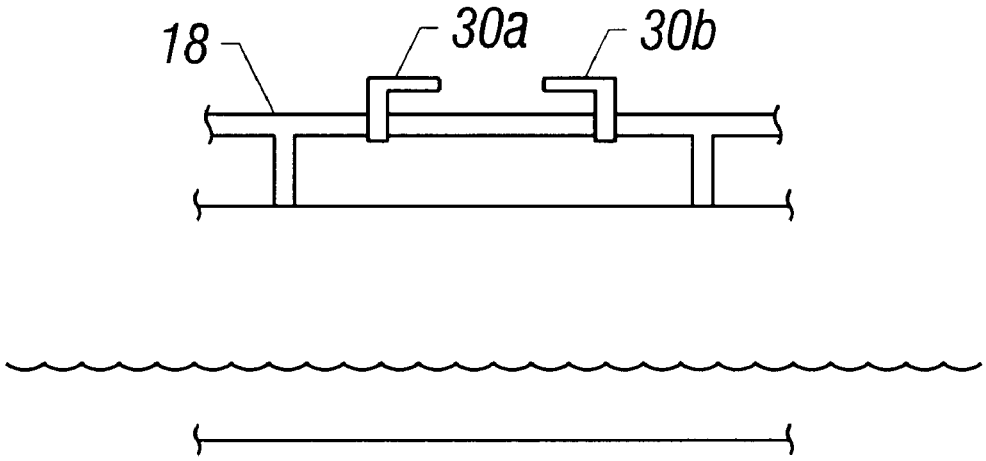

One or both of the parts of the swivel release spool 30*a* and 30*b* can be swiveled to release the ski rope 14 as shown in FIGS. 2B and 3*b*. In FIG. 2B, swivel release spool part 30*a* is swiveled to the open position which allows the ski rope 14 to be removed from the spool. In FIG. 3B, both swivel release spool parts 30*a* and 30*b* are rotated to the open position, which allows the ski rope 14 to be removed from the spool.

Figure 4A:
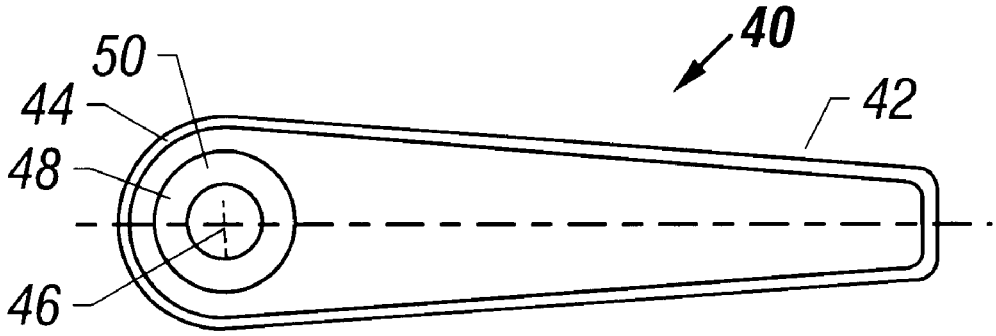
FIGS. 4A and 4B are sectional views of a releasable cleat.
Figure 4B:
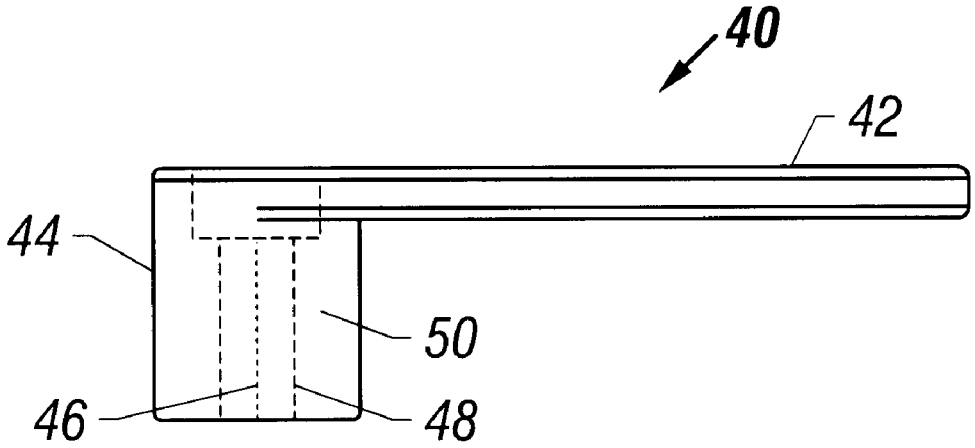

The swivel release spool parts 30*a* and 30*b* are configured to be detachably attached to a mounting surface and rotatable relative to that surface. In an example of a configuration, each of the swivel release spool parts 30*a* and 30*b* comprises a cleat 40, as shown in FIGS. 4A and 4B. Cleat 40 comprises an elongated handle 42 attached to a spacer cylinder 44. Spacer cylinder 44 is pierced along its axis 46 by a bolt chamber 48 and a countersink chamber 50. The countersink chamber 50 has a larger bore than and is coaxial with the bolt chamber 48. When two cleats 40 are oriented such that their spacer cylinders 44 are parallel, as shown in FIGS. 2A, 2B, 3A, and 3B, they form a spool upon which ski rope 14 can be wound. A cleat mount, described below (clamping lock 60, plate 100, or slide mount 120), attaches the cleat 40 to the ski boat 10.

Figure 5A:
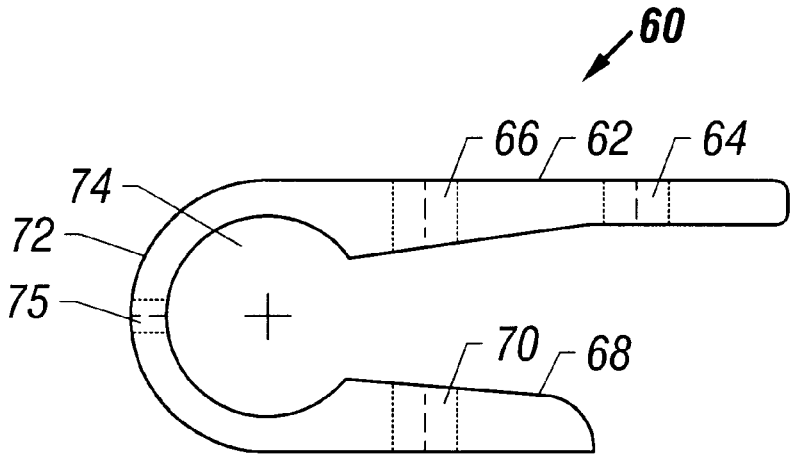
FIG. 5A is a sectional view of a clamping lock.
Figure 5B:
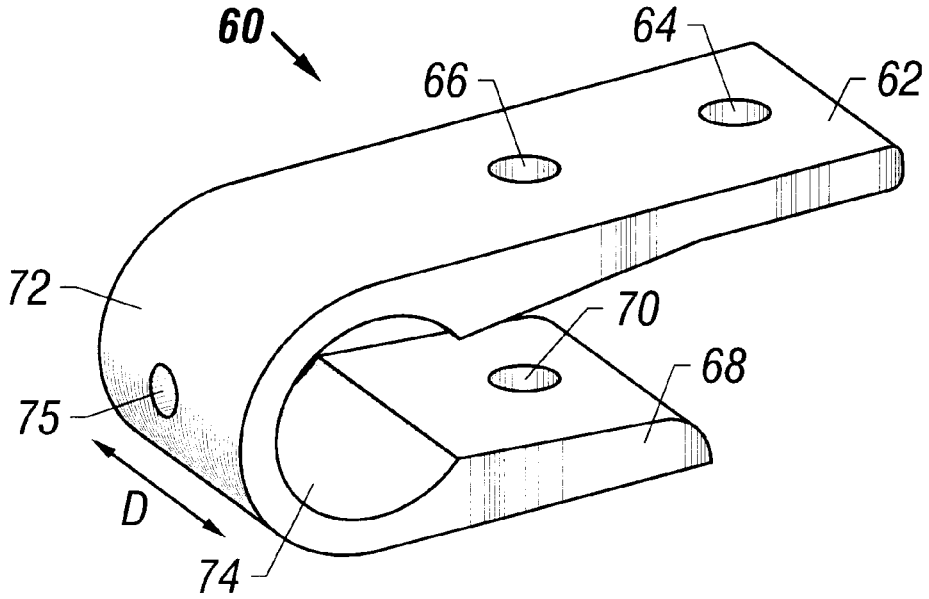
FIG. 5B is a perspective view of a clamping lock.

Each of the swivel release spool parts 30*a* and 30*b* comprises a clamping lock 60, illustrated in FIGS. 5A and 5B. The clamping lock 60 comprises plastic or aluminum, or some other material, formed roughly in the shape of clothes-pin thickened in dimension D as shown in FIG. 5B. It can readily be appreciated by those skilled in the art that the clothes-pin shape is not the only shape that will provide the advantages of the invention. The clamping lock 60 comprises a cleat attachment arm 62 which is pierced by a cleat attachment chamber 64 and an upper clamping chamber 66. The clamping lock 60 also comprises a clamping arm 68, shorter than the cleat attachment arm 62, which is pierced by a lower clamping chamber 70. The cleat attachment arm 62 and the clamping arm 68 are connected to opposite ends of spring 72 which is formed around a cylindrical tube-gripping chamber 74. Spring 72 is pierced by set screw chamber 75.

Figure 6:
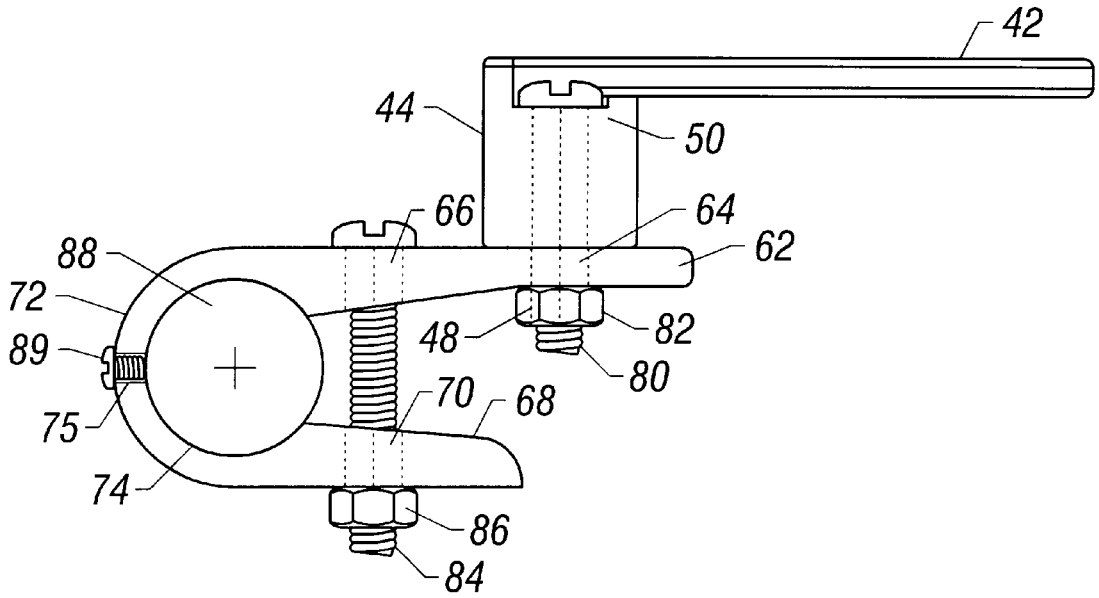
FIG. 6 is an sectional view of an assembled clamping lock and cleat attached to a tube.

An swivel release spool part 30*a* or 30*b* is assembled from the cleat 40 and clamping lock 60, as shown in FIG. 6. A cleat attachment bolt 80 extends through the countersink chamber 50 and the bolt chamber 48 of the spacer cylinder of the cleat. The cleat attachment bolt 80 also extends through the cleat attachment chamber of the cleat attachment arm of the clamping lock and is secured in place by cleat attachment nut 82. Cleat attachment bolt 80 and cleat attachment nut 82 attach the cleat 40 to the clamping lock 60. After the cleat attachment bolt 80 and cleat attachment nut 82 are tightened, cleat 40 can be rotated around the axis formed by the cleat attachment bolt 80. This rotatability provides the cleat the ability to open and close by rotating.

A clamping bolt 84 extends through the upper clamping chamber 66 of the cleat attachment arm 62 of the clamping lock 60. The clamping bolt 84 extends through the lower clamping chamber 70 in the clamping arm 68 of the clamping lock 60 and is secured in place by clamping nut 86. By tightening clamping bolt 84 and clamping nut 86, spring 72 can be compressed causing tube-gripping chamber 74 to close and tighten against tube 88. Set screw 89, which is inserted into set screw chamber 75, may be tightened to secure the swivel release spool part 30*a* or 30*b* in place. When the swivel spool part 30*a* and 30*b* are attached to a tube 88 as shown in FIG. 6, the cleat 40 can be opened and closed as shown in FIGS. 2A, 2B, 3A, and 3B.

The tube 88 is inserted into the tube-gripping chamber 74 in one of two ways. First, if one end of the tube 88 is free, the tube-gripping chamber 74 can be slid over the free end of the tube 88 and then secured in place by tightening the clamping bolt 84 and clamping nut 86. This insertion approach would be useful, for example, when attaching the swivel spool part 30*a* or 30*b* to the free end of a side rail 20.

Figure 7:
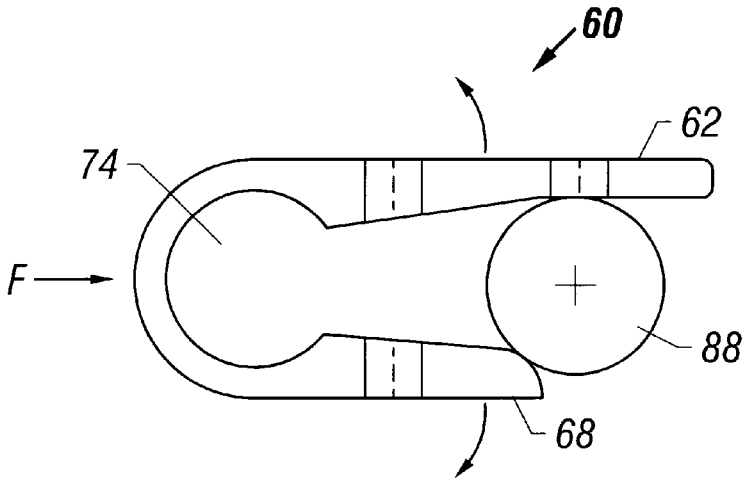
FIG. 7 is a sectional view of a clamping lock being attached to a tube.

Alternatively, and particularly if the tube 88 does not have a free end, the clamping lock can be snapped onto the tube, as shown in FIG. 7. If tube 88 is held in place and the clamping lock 60 is pressed against the tube with a force F, as shown in FIG. 7, the cleat attachment arm 62 and the clamping arm 68 will deflect as shown in FIG. 7, allowing the tube 88 to penetrate to and snap into the tube-gripping chamber 74. The clamping bolt and clamping nut can then be tightened, securing the clamping lock, and thus the swivel spool part 30*a* or 30*b*, into place. This attachment approach can be used in the situations illustrated in FIGS. 2A, 2B, 3A, and 3B.

Figure 8A:
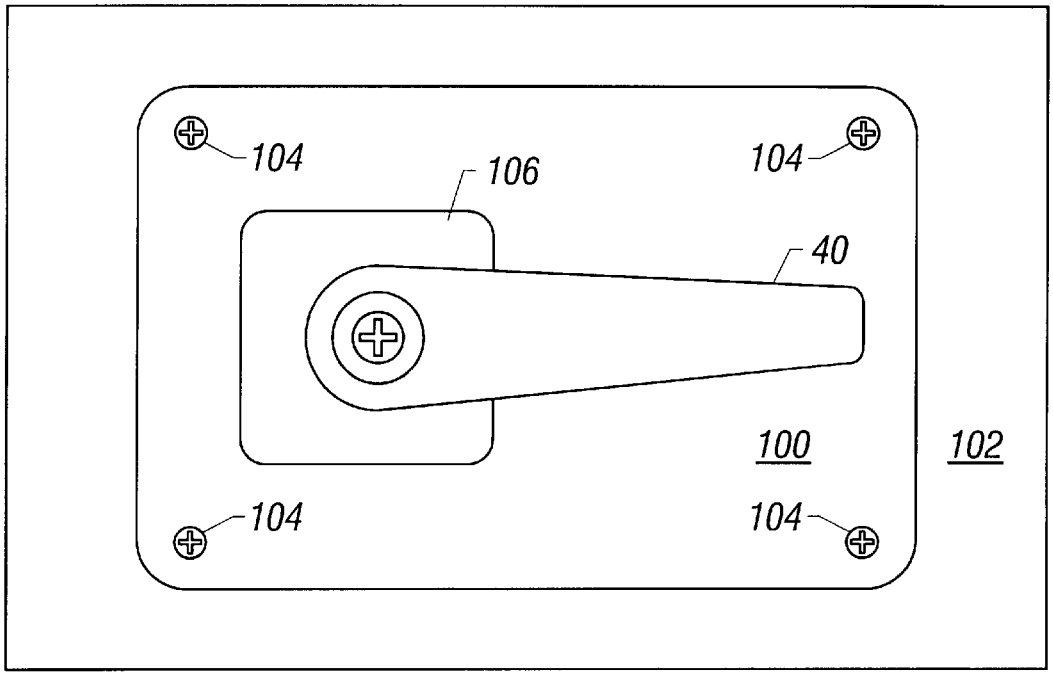
FIGS. 8A and 8B are sectional views of a cleat mounted using a mounting plate.
Figure 8B:
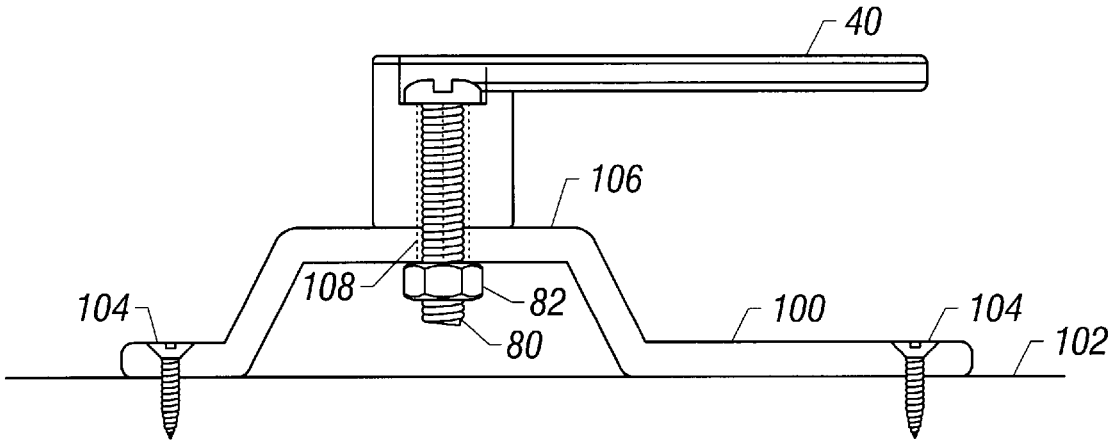

Cleat 40 can also be mounted, for example, as shown in FIGS. 8A and 8B. A metal or plastic plate 100 is mounted to a surface 102 using mounting screws 104. Plate 100 may be flat or any other shape necessary to allow mounting to surface 102. The mounting surface can be metal, wood, or plastic or any other material. The plate 100 has a raised portion 106. A hole 108 is drilled through the raised portion 106. The cleat is attached to the plate by using the cleat attachment bolt 80 and cleat attachment nut 82 as described above for FIG. 6. With the cleat mounted as shown in FIGS. 8A and 8B, the swivel spool part 30*a* or 30*b* can be mounted on any surface, including a wall or a post.

Figure 9A:
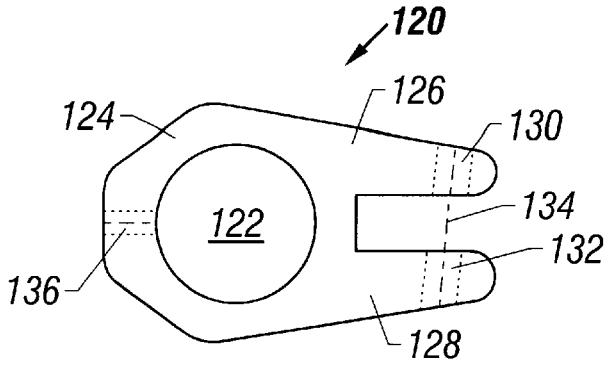
FIGS. 9A and 9B are sectional views of a slide mount.
Figure 9B:
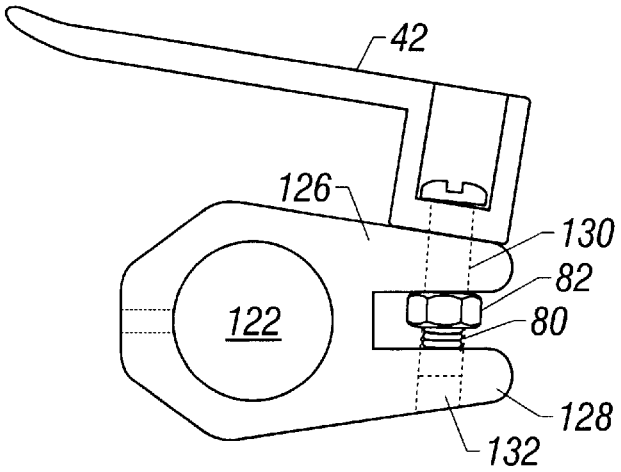
Figure 9C:
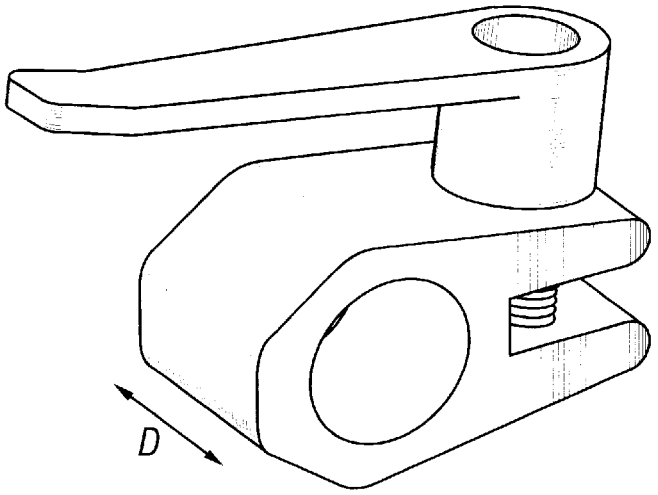
FIG. 9*c* is a perspective view of a slide mount.

A swivel spool part 30*a* or 30*b* can also be constructed as shown in FIGS. 9A, 9B and 9C. Slide mount 120, illustrated in FIG. 9A, is formed from plastic, metal, or other material into the shape of a clothes-pin, widened in the dimension D, as shown in FIG. 9C. It can be appreciated by those skilled in the art that the clothes-pin shape is not the only shape that will provide the advantages of the invention. The open end of the clothes-pin shape is closed, as shown in FIG. 9A, forming a cylindrical tube chamber 122, which is surrounded by a tube-gripping cylinder 124. An upper arm 126 and a lower arm 128 extend from the tube-gripping cylinder 124. A cleat attachment chamber 130 pierces the upper arm 126 and a bolt accepting chamber 132 pierces the lower arm 128. The cleat attachment chamber 130 and the bolt accepting chamber 132 share the same axis 134. A set screw chamber 136 pierces the tube-gripping cylinder 124 opposite the upper and lower arms 126 and 128.

Elongated handle 42 is attached to the slide mount 120, as shown in FIG. 9B, by inserting cleat attachment bolt 80 through cleat attachment chamber 130, through cleat attachment nut 82, and into bolt accepting chamber 132. Cleat attachment nut 130 is then tightened, securing elongated handle 42 to slide mount 120, producing the swivel spool part 30*a* or 30*b*, as shown in FIG. 9C. Set screw 84 is inserted into set screw chamber 136 and tightened in order to secure the slide mount to the tube which extends through the cylindrical tube chamber 122.

Figure 10:
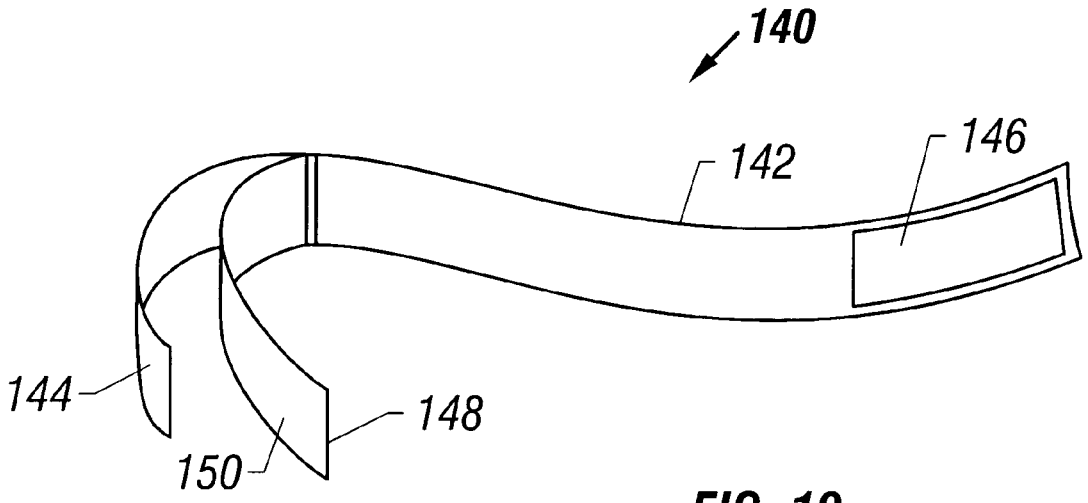
FIG. 10 is a perspective view of a strap.

A strap 140, illustrated in FIG. 10, is used to secure the ski rope 14 wrapped between the cleats and the handle 16 to the rail 20 when the cleats are in use. The strap can take any configuration that accomplishes this purpose. For example, the strap 140 may be constructed from an elongated cloth strip 142 having VELCRO hook receptor material on one side 144. A patch of VELCRO hook material 146 is attached to the opposite side at one end of the elongated cloth strip 142. A wrapping strip 148 is attached to the same side of the elongated cloth strip 142 as the patch, so that it lays parallel to the elongated cloth strip 142 and extends beyond the end of the elongated cloth strip 142 that does not have the patch 146. The wrapping strip has VELCRO hook material along its surface 150 that faces the elongated cloth strip 142.

Figure 11:
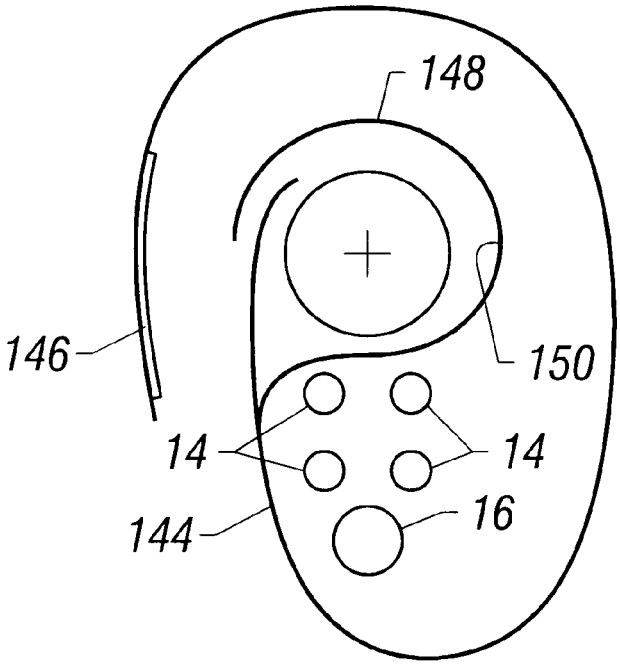
FIG. 11 is a sectional view of a strap, ski rope and handle attached to a rail.
Figure 12:
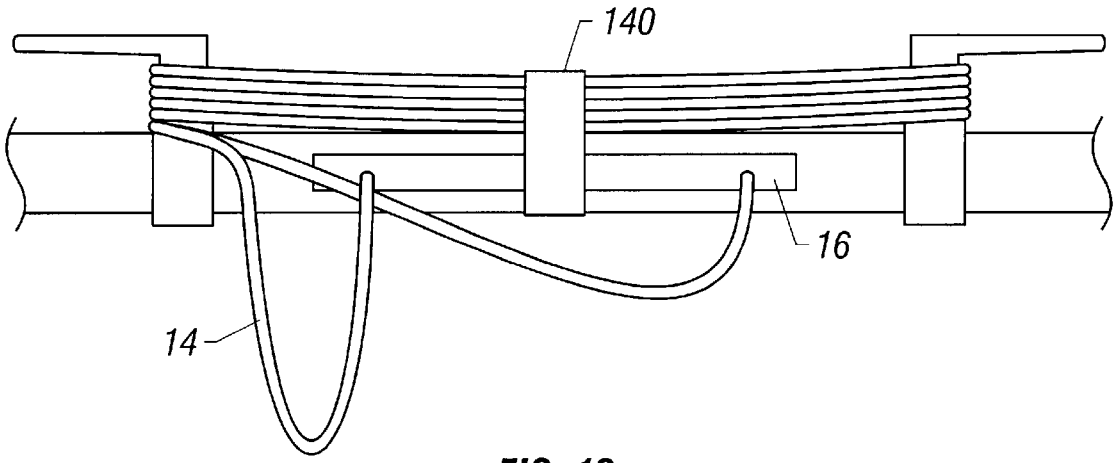
FIG. 12 is a perspective view of a strap, ski rope and handle attached to a rail.

In use, as shown in FIG. 11, the wrapping strip and the end of the elongated cloth strip 142 without the patch 146 are wrapped around the rail 20 so that the VELCRO hook material along surface 150 of the wrapping strip engages and attaches to the VELCRO hook receptor material on the elongated cloth strip 142. This action attaches strap 140 to the rail 20. The ski rope 14 and handle 16 are then gathered into a loop formed by the elongated cloth strip 142, as shown in FIG. 11. The end of the elongated cloth strip 142 with the patch 146 is wrapped around the ski rope 14, the handle 16 and the rail 20 in such a way that the patch 146 of VELCRO hook material engages and attaches to the VELCRO hook receptor material on the elongated cloth strip 142, as shown in FIG. 11. The result, illustrated in FIG. 12, is the ski rope 14 and handle 16 attached to the rail 20 by strap 140.

It can be appreciated that the usefulness of this invention is not limited to providing a releasable spool for ski rope. It can be useful in any situation where it would be useful to provide a swivel release spool for rope, cord, wire, or any other similar material.

Other embodiments are envisioned to fall within the scope of the following claims.

What is claimed is:

1. A swivel release rope spool comprising a clamp lock comprising a flexible spring having a first end and a second end;

a clamping arm, having a first end and a second end, the first end of the clamping arm being coupled to the first end of the spring;

a cleat attachment arm, having a first end and a second end, the first end of the cleat attachment arm being coupled to the second end of the spring;

the flexible spring, clamping arm and cleat attachment arm forming a chamber;

a passage between the clamping arm and the cleat attachment arm communicating with the chamber;

the cleat attachment arm comprising a cleat attachment portion adjacent the second end of the cleat attachment arm, the cleat attachment portion extending beyond an end of the passage; and a first rotatable cleat coupled to the the cleat attachment portion.

2. The swivel release rope spool of claim 1 further comprising a second rotatable cleat configured to detachably attach to a mounting surface;

the second rotatable cleat being orientable relative to the first rotatable cleat in such a way as to form a spool.

3. The swivel release rope spool of claim 2 further comprising a strap configured to secure to the mounting surface a member extending between the first rotatable cleat and the second rotatable cleat.

4. The swivel release rope spool of claim 3 wherein the strap comprises an elongated strip having a hook receptor side;

a patch attached to the side of the elongated strip opposite the hook receptor side, the patch having hooks; and a wrapping strip attached to the elongated strip, the wrapping strip having hooks.

5. A swivel release rope spool comprising a clamp lock comprising a flexible spring having a first end and a second end;

a clamping arm, having a first end and a second end, the first end of the clamping arm being coupled to the first end of the spring;

a cleat attachment arm, having a first end and a second end, the first end of the cleat attachment arm being coupled to the second end of the spring;

the flexible spring, clamping arm and cleat attachment arm forming a chamber;

a passage between the clamping arm and the cleat attachment arm communicating with the chamber;

the passage narrowing as it approaches the chamber; and a cleat coupled to the cleat attachment arm.

6. A method for providing a swivel release rope spool comprising coupling a first end of a clamping arm to a first end of a spring;

coupling a first end of a cleat attachment arm to a second end of the spring so that the cleat attachment arm, clamping arm and the spring form a chamber and a passage communicating with the chamber, the passage narrowing as it approaches the chamber; the cleat attachment arm comprising a cleat attachment portion extending beyond the passage; and coupling a first rotatable cleat to the cleat attachment portion.

7. The method of claim 6 further comprising pressing a first surface into the passage so that the passage expands and allows the first surface to enter into the tube-gripping chamber;

orienting the first rotatable cleat in a first direction.

8. The method of claim 6 comprising mounting a second rotatable cleat on a second surface; and orienting the second rotatable cleat relative to the first rotatable cleat so that the rotatable cleats form a spool.

9. The method of claim 8 further comprising opening one of the cleats to open the spool.

10. The method of claim 8 further comprising opening both of the cleats to open the spool.

* * * * *